United States Patent [19]

Von Holdt

[11] Patent Number: 4,966,298

[45] Date of Patent: Oct. 30, 1990

[54] LOCKING CONTAINER CONNECTOR SYSTEM

[76] Inventor: John W. Von Holdt, 6864 Lexington La., Niles, Ill. 60648

[21] Appl. No.: 173,569

[22] Filed: Mar. 25, 1988

[51] Int. Cl.[5] ..... B65D 21/02

[52] U.S. Cl. ..... 220/23.4; 206/504

[58] Field of Search ..... 220/23.4, 23.6; 206/504

[56] References Cited

U.S. PATENT DOCUMENTS

| | | | |
|---|---|---|---|
| 2,812,009 | 11/1957 | Eugan | 220/23.4 |
| 3,167,458 | 1/1965 | Brazell | 220/23.4 X |
| 3,307,729 | 3/1967 | Schwartz | 220/23.4 X |
| 3,369,658 | 2/1968 | Hasselmann | 220/23.4 X |
| 3,683,549 | 8/1972 | Simmon | 220/23.4 X |
| 3,815,281 | 6/1974 | Kander | 206/504 X |
| 3,944,074 | 3/1976 | Riley | 206/504 X |
| 4,003,491 | 1/1977 | Wells et al. | 206/504 X |
| 4,155,479 | 5/1979 | Liechti et al. | 220/23.4 |
| 4,228,897 | 10/1980 | Underwood | 206/504 |
| 4,416,373 | 11/1983 | de Larosiere | 220/23.4 X |
| 4,607,746 | 8/1986 | Stinnette | 220/23.4 X |

FOREIGN PATENT DOCUMENTS

| | | | |
|---|---|---|---|
| 1954298 | 5/1971 | Fed. Rep. of Germany | 206/504 |
| 2128345 | 6/1973 | Fed. Rep. of Germany | 220/23.4 |

*Primary Examiner*—Harvey C. Hornsby
*Assistant Examiner*—Stephen F. Gerrity
*Attorney, Agent, or Firm*—Allegretti & Witcoff, Ltd.

[57] ABSTRACT

A container is made of a substantially flexible material. A circumferentially extending array of longitudinally extending teeth are carried by the container and spaced from each other by recesses of a shape proportioned to receive identically-shaped teeth of an adjacent container of similar shape. The teeth each define a transversely enlarged, radially outer portion relation to a radially inner portion. The portions are proportioned to permit snap-fit, locking engagement of a tooth of the container between a pair of teeth of the adjacent container of similar shape.

12 Claims, 1 Drawing Sheet

FIG. 1
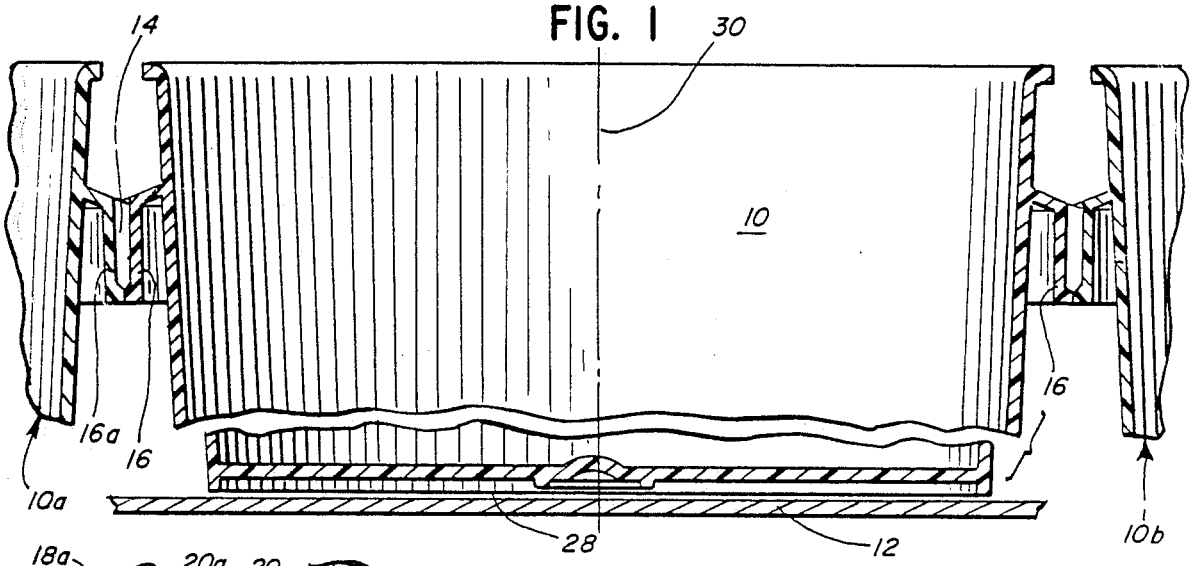
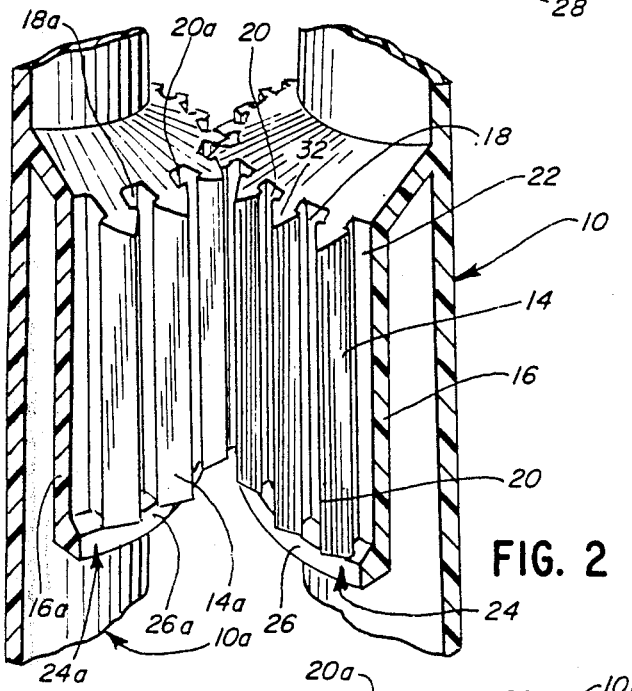
FIG. 2
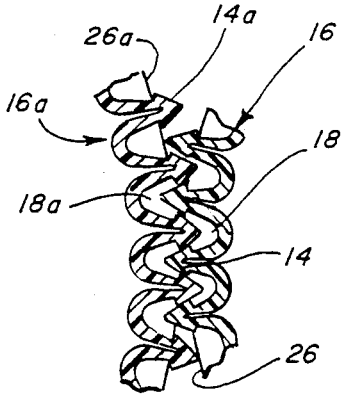
FIG. 4
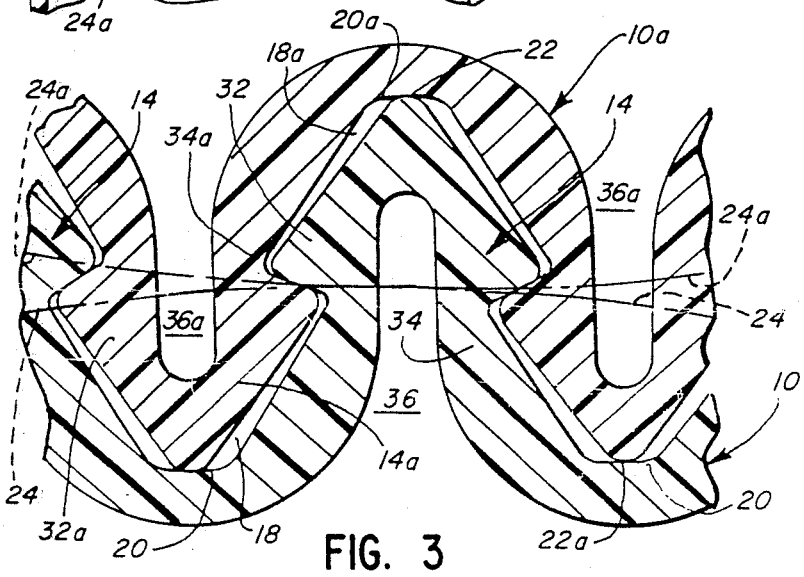
FIG. 3
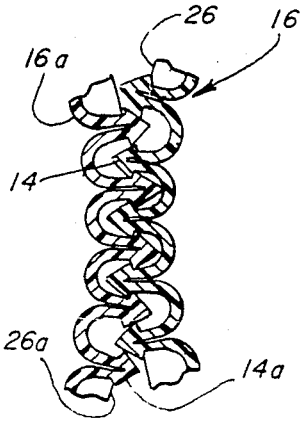
FIG. 5

LOCKING CONTAINER CONNECTOR SYSTEM

BACKGROUND OF THE INVENTION

The invention of this application constitutes an improvement to the invention of my prior pending patent application Ser. No. 62,452 filed June 15, 1987.

Containers such as paint buckets, and many other containers of various types, are processed by automated means, being placed on a conveyor belt, and automatically filed and capped. Such a conveyor operation is relatively critical, requiring very fine adjustment of the various parameters of operation for efficient processing. For example, plastic containers such as paint buckets, when empty, can be easily thrown out of position as they move along a conveyor belt around curves and the like. Some of the paint buckets can ride up on a paint bucket next to it, assuming a tilted configuration which may prevent effective automated filling of the container, with paint spilling over the edge of the tilted container.

Similarly, filled plastic or metal containers may be stored in warehouses in large stacks. Theoretically there should be no problem with this, even though the containers may be heavy. However, in actual fact, a container may tilt here as well, or the central portion of the stack of containers may sag slightly out of the plane of each level of containers in the stack, resulting in a focusing of the weight of the stack on one or more of the containers found therein. The result of this may be that such a container may rupture, ruining a substantial amount of the inventory and requiring disassembly of the stack of containers and a clean up operation.

In accordance with this invention, a container interlock system is provided to reduce or eliminate the problems described above. The containers of this invention may be carried in connected relation to each other on a conveyor belt, with their interlocking relationship preventing containers from tilting upwardly or downwardly, or slipping to the side as the conveyor belt proceeds around curves, preventing effective processing by automated machinery in the conveyor line.

Similarly, when filled containers of this invention are stacked, their interlocking relationship can maintain them in a precise location without shifting of position, so that the stresses of the load imparted by the stack of containers will not be focused on a single, individual container, resulting in its damage.

Additionally, it is often desirable to hold large, plastic buckets together, for example for transporting the empty buckets from place to place. Thus, it would be desirable if the empty buckets could be temporarily snapped together, so that a worker could pick up an arm load of them for easy carrying. With empty containers, weight is not the problem but bulk, and containers that temporarily lock together could be carried in large numbers by a worker, for example in a line of five or six adhering containers which can be carried by pressing with each hand the containers that are at the respective ends of the line.

Additionally, containers that temporarily lock together can be assembled into a locked, two dimensional mass such as a rectangular array of containers, four or five on a side for example, which can then be stored or moved around as a single mass until separation is desired.

By the invention of this application, a bucket is provided having characteristics to achieve any or all of the above objectives.

DESCRIPTION OF THE INVENTION

In this invention, a container is provided which is made of a substantially flexible material, generally a typical material out of which plastic buckets are made, the bucket being self-supporting and overall rigid, but having sufficient flexibility to accomplish the purposes of this invention as described.

In accordance with this invention, a circumferentially extending array of longitudinally extending teeth is provided. The teeth are spaced from each other by recesses of a shape proportioned to receive identically-shaped teeth of an adjacent container of similar shape. The recesses each define a radially recessed bottom surface, and the teeth each define a radially projecting top surface.

Preferably, the container also defines a circumferential flange substantially continuously extending across one end of each of the teeth. The flange defines a circumferentially extending surface which occupies a radial level which is between the radial levels of the bottom surfaces and the top surfaces. As a result of this, the interengaging teeth of the container and another identical container cannot move longitudinally, because each set of teeth projects inwardly of the circumferential flange of the other container, thus preventing relative longitudinal motion of the teeth with respect to each other.

Additionally in accordance with this invention, the teeth each define a transversely enlarged, radially outer portion relative to a radially inner portion. The portions are proportioned to permit snap-fit, locking engagement of a tooth of the container between a pair of the teeth of the adjacent container of similar shape. Thus, buckets made in accordance with this invention may be snapped together rather in the spirit of plastic pop beads, and may be popped apart again, as desired.

The transversely enlarged, radially outer portion of the teeth may be of generally arrowhead shape in cross-section. This facilitates the snap-in and snap-out capability of the container with another container of similar design.

Specifically, the cross-sectional arrowhead shape of the teeth may each be defined by a transversely enlarged, radially outer portion relative to a radially inner portion. The transversely enlarged, radially outer portion may define a pair of outer surfaces that converge outwardly to a radially projecting top surface at a first angle to a radius from the container longitudinal axis. The radially outer portion also defines a pair of inner surfaces that diverge outwardly to join the innermost portions of the outer surfaces. The inner surfaces define a second angle to a radius from the container longitudinal axis, with the second angle being greater that the first angle. Thus, the teeth are proportioned to permit snapfit, locking engagement of a tooth of the container between a pair of teeth of the adjacent container of similar shape.

Additionally, the longitudinally extending teeth may define hollow interior portions, to provide increased flexibility to the teeth. This, in turn, provides easier movement into and out of the snap-fit locking engagement.

As a further preferred feature and advantage of the invention, the teeth may be proportioned to permit an outer, interengaging relation between adjacent containers of similar shape to permit the containers to engage each other without snap-fit relation and to be in fixed rotational relation with each other so that as one container rotates the other must rotate. Additionally, in this outer, engaging relation, the outermost ends of the teeth may overlap the respective circumferential flanges of the containers, when that flange is present, to prevent longitudinal movement between the containers as previously described. However, in this outer interengaging relation, the containers may be free of snap-fit engagement, so that they be freely separable as desired, but moveable along a filling line in linear array, being locked together against relative longitudinal motion, and also locked together in interengaging rotational relation with each other.

Alternatively, the teeth of each container can occupy an inner, interengaging relation between the adjacent containers, with the teeth being in the above described snap-fit, locking engagement.

The term "longitudinal motion" refers to motion of a container in the direction of its longitudinal axis, which is generally in the vertical direction, and perpendicular to the direction of motion of containers moving along a filling line. The preferred structure of this invention prevents the containers, when engaged with each other, from such relative longitudinal motion parallel to their axes, as well as preventing relative motion transverse to their axes. Nevertheless, in preferred embodiments, the containers of this invention are free to rotate relative to each other. Thus, containers in conveyor line cannot tilt upwardly one with respect to the other, and cannot be jostled out of line or the like.

Also, when a plurality of such identical containers are horizontally grouped together in physical contact, with their teeth in interengaging relation to define rows of containers along two different axes transverse to each other (for example, a layer of containers in a large stack thereof) the containers in the center of the array are preferably prevented from sagging due to the weight of containers on top of them in the stack by the retaining action against relative longitudinal motion as described above. Hence, the focusing of compressing force on individual containers due to the weight of the stack is suppressed. As a result of this, larger and higher stacks of the containers of this invention may be used in warehouses, for more efficient storage of the containers of this invention without crushing damage to the containers in the lower portions of the stacks.

Strap means may be provided to surround each layer of containers, to hold them together in physical contact to assure continued engagement of the teeth together Additionally, or alternatively, the snap-fit locking engagement capability of the containers of this invention may also provide the function of firm, positive retention of the containers together.

If desired, the other ends of the teeth may also carry a circumferential flange of the type described above, to provide an increase in the resistance to heavy pressures that would tend to cause engaged containers to disengage and move in the longitudinal direction. This second circumferential flange can provide the same kind of locking against relative longitudinal motion and thus can increase the strength of the container.

Typically, no substantial circumferentially extending areas are present between the teeth which are substantially at the radial level of the circumferentially extending surface.

While the container of this invention may be one of substantially circular cross-section, for example a paint bucket or other wide-mouthed container, advantages may also be achieved in accordance with this invention with containers which are of substantially rectangular or other polygonal cross-section. Containers which are of substantially circular cross-section may be locked together to prevent relative motion in either the longitudinal or transverse directions, but the containers can still rotate with respect to each other, so that such containers may easily run in locked relation to each other on a horizontally curved conveyor path made of a plurality of rollers or the like. Naturally, containers of substantially rectangular cross-section cannot rotate with respect to each other. Nevertheless, they exhibit advantage in that they may be temporarily interlocked in accordance with this invention, to be retained together on a straight conveyor line and also to permit handlers to pick up a row of interlocked, typically empty containers by simply pressing together with the hands the first of said row of containers and the last of said row. In that circumstance, the entire row of containers, of any cross-sectional shape, may be held together by this invention for convenient transfer or handling.

The continuous array of longitudinally extending teeth may be carried on a circumferential skirt which substantially surrounds the periphery of the container. Such a skirt may be easily molded without side action as an integral part of a molded plastic container in preferred designs thereof. Also, the skirt serves to provide added hoop strength to the container, particularly when it is located near the mouth thereof. However the teeth of the container may be located anywhere on the container, for example adjacent the bottom thereof, if desired. Also, two or more arrays of teeth may be applied to the container in accordance with this invention, either in a manner completely surrounding the container, or in separate rows, if desired.

DESCRIPTION OF THE DRAWINGS

In the drawings, FIG. 1 is a fragmentary, longitudinal sectional view of a series of plastic buckets made in accordance with this invention, positioned on a conveyor belt, showing how adjacent buckets can be held in interlocking relation for stabilization of the individual buckets as they move along the conveyor line;

FIG. 2 is a fragmentary, enlarged perspective view of portions of two interengaging buckets of FIG. 1;

FIG. 3 is a fragmentary, further enlarged, transverse sectional view of the interengaging portions of the buckets as shown in FIG. 2;

FIG. 4 is a partial sectional view of interengaging buckets in accordance with FIGS. 1–3 shown in their outer engaging relation, free of snap-fit engagement; and FIG. 5 is a fragmentary transverse sectional view of the engaging portions of buckets of FIGS. 1–3 in the inner interengaging relation in snap-fit, locking engagement, so that the containers are positively connected together.

DESCRIPTION OF SPECIFIC EMBODIMENT

Referring to the drawings, FIG. 1 shows a molded plastic bucket 10, which may be of any desired design for holding food, chemicals, paint, or the like. Bucket 10 is shown to be carried on a moving filling line comprising conveyor belt 12 and is part of a connected array of buckets of identical design, being positioned between buckets 10a on one side and 10b on the other. The line of connected buckets 10, 10a, 10b is being moved on automated conveyor belt 12 between, for example, automated filling and sealing stations. For example, the buckets may be of the size, design, and shape of conventional paint buckets, except for the array of teeth in accordance with this invention, being filled and sealed in conventional paint bucket filling and sealing machinery.

In accordance with this invention bucket 10 (and buckets 10a, 10b) carries a circumferentially extending array of longitudinally extending teeth 14, the teeth 14 of bucket 10 being carried on a circumferential skirt 16 connected to bucket 10. FIG. 2 shows the interconnection between buckets 10 and 10a, with bucket 10a carrying teeth 14a on a skirt 16a of identical design to the corresponding teeth 14 and skirt 16 of bucket 10. Teeth 14, 14a are respectively separated by recesses 18, 18a, which are respectively each of a shape proportioned to receive identically-shaped teeth of an adjacent container of similar shape, this relation being shown in FIGS. 2 and 3.

Recesses 18, 18a each respectively define a radially recessed bottom surface 20, 20a, while teeth 14, 14a each respectively define a radially projecting top surface 22, 22a. The terms "bottom" and "top" are from the radial point of view, so that top surfaces 22, 22a are radially farther from the center of their respective container than bottom surfaces 20, 20a.

Skirt 16, 16a preferably defines an annular ring about the body of the container to which it is attached, with a continuous array of teeth 14, 14a being carried thereon.

Also, the respective containers 10, 10a define a circumferential flange 24, 24a which substantially continuously extends across one end of each of the respective teeth 14, 14a. Flanges 24, 24a define an outermost, circumferentially extending surface 26, 26a which occupies a radial level which is between the radial levels of bottom surfaces 20, 20a and top surfaces 22, 22a of the respective teeth of the container which carries the respective surfaces 26, 26a. As a result of this, and as described in the previously cited application Ser. No. 062,452, when the respective containers are in interengaging relation as shown in FIGS. 2–5, teeth 14 pass radially inwardly of flange 24a of container 10a. At the same time, teeth 14a pass radially inwardly of flange 24 of container 10, so that the respective teeth of one container at least partially lie against against circumferential flange 24, 24a of the other container. While in this relationship, it becomes impossible for either set of teeth to move longitudinally relative to the other set of teeth, with the result that the respective containers 10, 10a are locked against longitudinal movement, i.e., vertical movement with respect to conveyor belt 12. This is illustrated in FIG. 1 by the fact that container 10 is separated from conveyor belt 12 by a small space 28, being held in line by its interlocking relationship with container 10a, and the identical interlocking relationship with container 10b, so that container 10 cannot fall down to the level of conveyor belt 12 in the event of a small amount of sagging of conveyor belt 12 as shown.

The line of respective containers is vertically locked together so that the containers cannot bounce upwardly, or tilt, or move in a sideways manner out of line, because of the engagement between the respective teeth and because of the engagement with the respective teeth 14 with the respective circumferential flanges 24 on other containers. Nevertheless, the respective containers are free to rotate about their longitudinal axes 30 while remaining in linear array, so that conveyor belt 12 can be designed to turn corners with ease.

As shown in FIGS. 3–5, teeth 14, 14a each respectively define a transversely enlarged, radially outer portion 32, 32a, typically of the cross-sectional shape of an arrowhead as shown particularly in FIG. 3. Recesses 18, 18a may be of a shape which generally corresponds to the respective shape of outer portions 32, 32a, as shown. It can be seen that enlarged, radially outer portions 32, 32a of the respective buckets 10, 10a are enlarged relative to radially inner portions 34, 34a, as shown. The effect of this is to permit snap-fit, locking engagement of each of teeth 14, 14a respectively into recesses 18, 18a, of the adjacent container. The material of the containers of this invention may be flexible enough to permit this to take place, while the container retains enough stiffness to be strong and self supporting.

To faciliate the necessary flexibility of teeth 14, 14a, they may respectively define hollow interior portions 36, 36a which are free to exhibit a certain amount of collapse as the teeth are forced into snap-fit relation with the respective recesses The desired flexibility of teeth 14, 14a can be adjusted by appropriate adjustment of the size of hollow interior portions 36, 36a, a larger size of hollow interior portion providing more flexibility to the teeth for easier movement into and out of snap-fit relation and less retention strength in the snap-fit relation.

Turning to FIG. 4, the flanges 16, 16a of respective buckets are shown with the teeth 14, 14a being positioned in an outer, interengaging relation. In this outer position, the respective teeth are not in snap-fit relation with the recesses 18, 18a of their neighbor buckets, so that the buckets or containers may be removed from each other without any resistance at all. Nevertheless, the respective interengaging teeth 14, 14a prevent both lateral and longitudinal motion of the buckets with respect to each other while permitting them to rotate about their axes 30 as previously described. It can be seen that the engaging teeth 14, 14a overlie the circumferentially extending surface 26, 26a of the other bucket, so that relative longitudinal motion between the buckets is prevented in the manner described above. Circumferentially extending surfaces 26, 26a are not in contact with each other.

Turning to FIGS. 3 and 5, there is shown the relation between the buckets in which the teeth 14, 14a have been driven into their inner interengaging relation in which some of the enlarged outer portions 32, 32a of the teeth are respectively driven farther into recesses 18, 18a so that the snap-fit locking engagement of FIG. 3 is achieved. In this circumstance, the respective buckets are physically locked together, but can be pulled apart when and if desired. In this circumstance, the buckets are even more tightly retained against relative lateral or longitudinal movement, and, if desired, the outermost circumferentially extending surfaces 26, 26a of flanges 24, 24a can abut together at at least one central point. Nevertheless, it is still possible for the respective containers to rotate about their axes 30 while retaining their engagement, because as teeth pop out of snap-fit relation, other teeth enter into such relation.

Thus, the bucket of this invention exhibits significant advantages, particularly because it can be physically linked together to other buckets to form a mass of connected buckets which retain their orientation and do not slide around in a miscellaneous manner, until it is desired to disconnect them for use. Additionally, the bucket or container of this invention exhibits the advantages and solves the other problems previously discussed.

The above has been offered for illustrative purposes only, and is not intended to limit the scope of the invention of this application, which is as defined in the claims below.

That which is claimed is:

1. In a molded container made of substantially flexible material, the improvement comprising in combination:

an integrally molded component of said container comprising a circumferentially extending array of longitudinally extending teeth which are spaced from each other by recesses of a shape proportioned to receive identically-shaped teeth of an adjacent container of similar shape, said recess each defining a radially recessed bottom surface and said teeth each defining a radially projecting top surface; said container also defining a circumferential flange substantially continuously extending across one longitudinal end of each of said teeth, said flange defining an outermost circumferentially extending surface which occupies a radial level which is between the radial levels of the bottom surfaces and the top surfaces, whereby the interengaging teeth and recesses of said container and another, identical container cannot move longitudinally, said teeth each defining in cross section a generally arrowhead-shaped, transversely enlarged, radially outer portion relative to a radially inner portion, said portions being proportioned to permit snap-fit, locking engagement of a tooth of said container between a pair of teeth of said adjacent container of similar shape.

2. The container of claim 1 in which no substantial circumferentially extending areas are present between said teeth which are substantially at the radial level of said circumferentially extending surface.

3. The container of claim 1 in which said longitudinally extending teeth define hollow interior portions to provide increased flexibility to said teeth for easier movement into and out of said snap-fit, locking engagement.

4. The container of claim 1 in which said teeth are proportioned to permit an outer, interengaging relation between adjacent containers of similar shape to prevent longitudinal and lateral movement between the containers, while permitting rotational being free of snap-fit engagement, and said teeth can also occupy an inner, interengaging relation between said adjacent containers with said teeth being in said snap-fit, locking engagement.

5. The container of claim 1 in which said teeth are carried on a circumferential skirt connected thereto.

6. The container of claim 1 in which said transversely enlarged, radially outer portion is of generally arrowhead shape, defining a pair of outer surfaces that converge outwardly to a radially projecting top surface at a first angle to a radius from the container longitudinal axis, said outer portion also defining a pair of inner surfaces that diverge outwardly to join the innermost portions of the outer surfaces, said inner surfaces defining a second angle to a radius from the container longitudinal axis, said second angle being greater than said first angle.

7. In a container made of substantially flexible material, the improvement comprising, in combination:

a circumferentially extending array of longitudinally extending teeth which are spaced from each other by recesses of a shape proportioned to receive identically-shaped teeth of an adjacent container of similar shape, said recesses each defining a radially recessed bottom surface and said teeth each defining a radially projecting top surface; said container also defining a circumferential flange substantially continuously extending across one longitudinal end of each of said teeth, said flange defining an outermost circumferentially extending surface which occupies a radial level which is between the radial levels of the bottom surfaces and the top surfaces, whereby the interengaging teeth and recesses of said container and another, identical container cannot move longitudinally, said teeth each defining a transversely enlarged, radially outer portion relative to a radially inner portion, said transversely enlarged, radially outer portion being of generally arrowhead shape in cross section, said teeth defining hollow interior portions to provide increased flexibility to said teeth, to permit snap-fit, locking engagement of a tooth of said container between a pair of teeth of said adjacent container of similar shape.

8. The container of claim 7 in which said teeth are proportioned to permit an outer, interengaging relation between teeth of an adjacent container of similar shape to prevent longitudinal and lateral movement between the containers while permitting rotational movement, said teeth in outer interengaging relation being free of snap-fit engagement, and said teeth can also occupy an inner interengaging relation between said adjacent containers with said teeth being in said snap-fit, locking engagement.

9. The container of claim 8 in which said teeth are carried on a circumferential skirt connected thereto.

10. The container of claim 9 in which no substantial circumferentially extending areas are present between said teeth which are substantially at the radial level of said circumferentially extending surface.

11. The container of claim 7 in which said transversely enlarged, radially outer portion is of generally arrowhead shape, defining a pair of outer surfaces that converge outwardly to a radially projecting top surface at a first angle to a radius from the container longitudinal axis, said outer portion also defining a pair of inner surfaces that diverge outwardly to join the innermost portions of the outer surfaces, said inner surfaces defining a second angle to a radius from the container longitudinal axis, said second angle being greater than said first angle.

12. The container of claim 11 which is a molded container, the longitudinally extending teeth being an integrally molded component of said container.

* * * * *